US007073238B1

(12) United States Patent
Moore et al.

(10) Patent No.: US 7,073,238 B1
(45) Date of Patent: Jul. 11, 2006

(54) SINGLE SLITTING PROCESS FOR RECYCLING RAIL

(75) Inventors: Gregory Don Moore, Magnolia, AR (US); James Edward Melton, Boerne, TX (US); Stephen Gary Weaver, Magnolia, AR (US)

(73) Assignee: CMC Steel Fabricators, Inc., Seguin, TX (US)

( * ) Notice: Subject to any disclaimer, the term of this patent is extended or adjusted under 35 U.S.C. 154(b) by 0 days.

(21) Appl. No.: 10/635,948

(22) Filed: Aug. 7, 2003

(51) Int. Cl.
*B30B 9/32* (2006.01)
*B23P 17/04* (2006.01)

(52) U.S. Cl. ..... 29/403.2; 29/403.1; 29/412; 29/414; 29/557; 225/1

(58) Field of Classification Search ..... 29/403.1, 29/412, 414, 415, 417, 557, 558, 403.2; 225/1
See application file for complete search history.

(56) References Cited

U.S. PATENT DOCUMENTS 328,937 A * 10/1885 Hargreaves ..... 228/117
455,337 A * 7/1891 Jones, Jr. ..... 238/44
1,206,606 A * 11/1916 Slick ..... 72/223
3,133,343 A 5/1964 Kratkay
4,205,612 A 6/1980 Luttig
4,552,291 A * 11/1985 Schott ..... 225/96.5
4,646,954 A * 3/1987 Happ ..... 225/2
4,702,403 A * 10/1987 Curles ..... 225/96.5
4,720,032 A * 1/1988 LaBounty ..... 225/96.5
4,982,591 A 1/1991 McGahhey
5,704,998 A 1/1998 Gallagher, Jr.
6,227,025 B1 5/2001 Kutsuwada

FOREIGN PATENT DOCUMENTS

JP 2001096442 A * 4/2001

OTHER PUBLICATIONS

On-line computer translation of JP 2001096442A.*

* cited by examiner

*Primary Examiner*—Essama Omgba
(74) *Attorney, Agent, or Firm*—Haynes and Boone, LLP

(57) ABSTRACT

A method for recycling rail is provided wherein the rail is heated, and then slit into two pieces. The two pieces are passed through a single mill pass line such that each piece of the rail is deformed to have a generally uniform shape.

3 Claims, 3 Drawing Sheets

Fig. 3
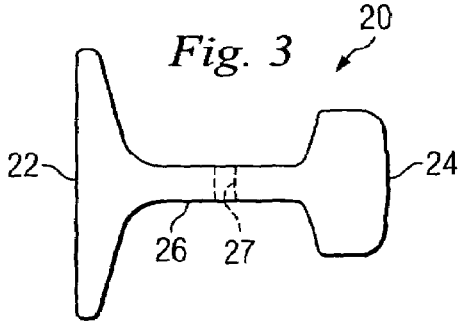
Fig. 4
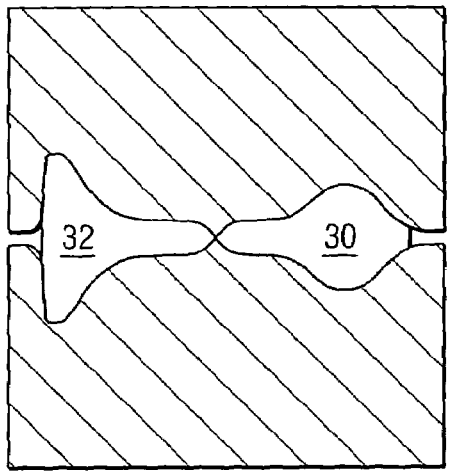
Fig. 5a
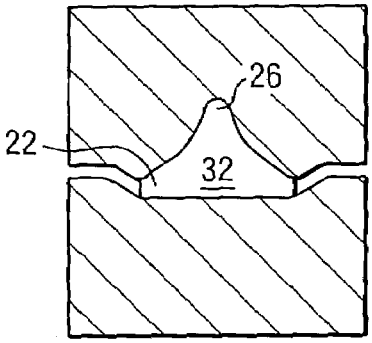
Fig. 5b
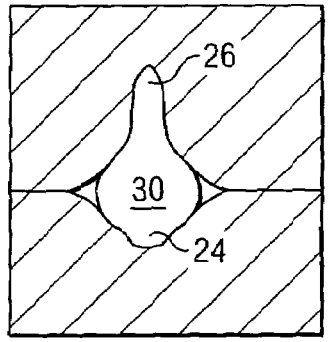
Fig. 6a
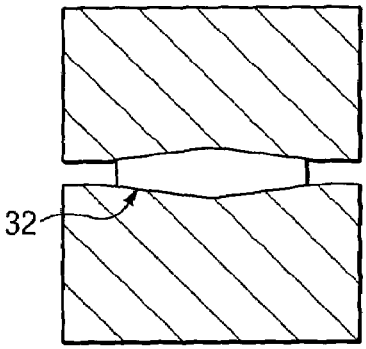
Fig. 6b
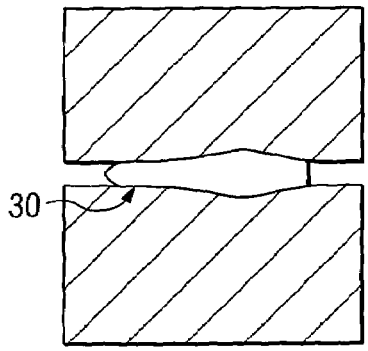
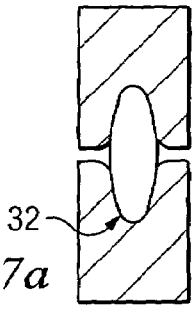
Fig. 7a
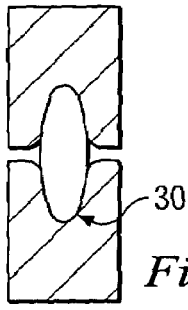
Fig. 7b

SINGLE SLITTING PROCESS FOR RECYCLING RAIL

BACKGROUND

The present disclosure relates generally to recycling worn rail, and more particularly to a process for recycling rail which reduces the amount of resources needed to recycle the rail while maintaining or improving the quality of the recycled rail and reducing the need to scrap portions of the rail.

It is common practice to recycle worn rail, such as worn railroad rail, into a variety of products such as t-post, rebar, angles, etc. by subjecting the rail to rolling operations. Rolling operations generally include heating of the rail to a plastic state and deforming of the rail into a generally uniform shape having a reduced cross-sectional area relative to the original worn rail.

As can be appreciated, rail typically does not take an easily workable shape such as a square, circle, or rectangle. Rather, most rail takes a unitary T-like shape to include a lower portion, a web portion, and an upper portion. Recycling such rail can be problematic due to the formation of structurally-deficient laps or seams that result from rolling rail having difficult geometric orientations. As such, it is often necessary to divide the rail into workable sections in a process known as slitting.

In the past, slitting has involved forming multiple slits in the rail to separate the lower portion, the web portion, and the upper portion of the rail prior to rolling. Oftentimes, the web portion of the rail will include holes or other attachment means to accommodate laying of the rail. Thus, the portions of the rail that include these holes need to be scrapped prior to the remainder of the rail undergoing deformation processes because deformation of porous portions of rail can lead to a structurally deficient finished product.

After scrapping the unusable portion of the rail, the lower, upper, and web portions of the rail are passed down separate deformation lines, often referred to as mill pass lines, during which each portion is subjected to rolling operations. Thus, multiple mill pass lines are required in order to accommodate passage of the lower, upper, and web portions of the rail during such rolling operations. Each mill pass line requires a considerable amount of equipment including mill stands, conveyors, guiding systems, cooling beds, finishing shears, bundling systems, etc. Furthermore, each mill pass line requires employees to supervise the rolling operations. As can be appreciated, the cost of running multiple mill pass lines during the recycling of worn rail can be economically burdensome due to the amount of equipment and number of employees needed for such operations.

Therefore, what is needed is a rail recycling process that reduces the number of mill pass lines while maintaining or improving the quality of the recycled rail and reducing the need to scrap portions of the rail.

SUMMARY

A method for recycling rail is provided in which the rail is heated and then slit to separate the rail into a first piece and a second piece. The first and second pieces of the rail are then deformed.

In another embodiment, a method for recycling rail in a single mill pass line is provided in which the rail to be recycled includes a lower portion, an upper portion, and a web portion linking the lower portion and the upper portion.

The rail is heated and then slit across the web portion of the rail to separate the rail into a first piece and a second piece. The first and second pieces of the rail are then deformed by being passed through at least one reduction pass. Deformation of the first and second pieces of the rail causes the first and second pieces to have a generally uniform shape.

In yet another embodiment, a method for reducing structural defects in recycled rail is provided in which the rail to be recycled includes holes formed therein. The rail is slit across the holes to separate the rail into a first piece and a second piece. Slitting across the holes defines partial holes in each of the first and second pieces. The first and second pieces of the rail are then deformed by being passed through at least one reduction pass. Deformation of the first and second pieces of the rail eliminates the partial holes of the first and second pieces.

BRIEF DESCRIPTION OF THE DRAWINGS

FIG. 3 is a schematic side view of the rail of FIG. 2*a*.

FIG. 4 is a schematic view of the rail of FIG. 2*a* after having undergone a first reduction pass.

FIG. 5*a* is a schematic view of a flange of the rail of FIG. 2*a* after having undergone a second reduction pass.

FIG. 5*b* is a schematic view of a head of the rail of FIG. 2*a* after having undergone a second reduction pass.

FIG. 6*a* is a schematic view of the flange of the rail of FIG. 2*a* after having undergone a third reduction pass.

FIG. 6*b* is a schematic view of the head of the rail of FIG. 2*a* after having undergone a third reduction pass.

FIG. 7*a* is a schematic view of the flange of the rail of FIG. 2*a* after having undergone a fourth reduction pass.

FIG. 7*b* is a schematic view of the head of the rail of FIG. 2*a* after having undergone a fourth reduction pass.

DETAILED DESCRIPTION

Figure 1:
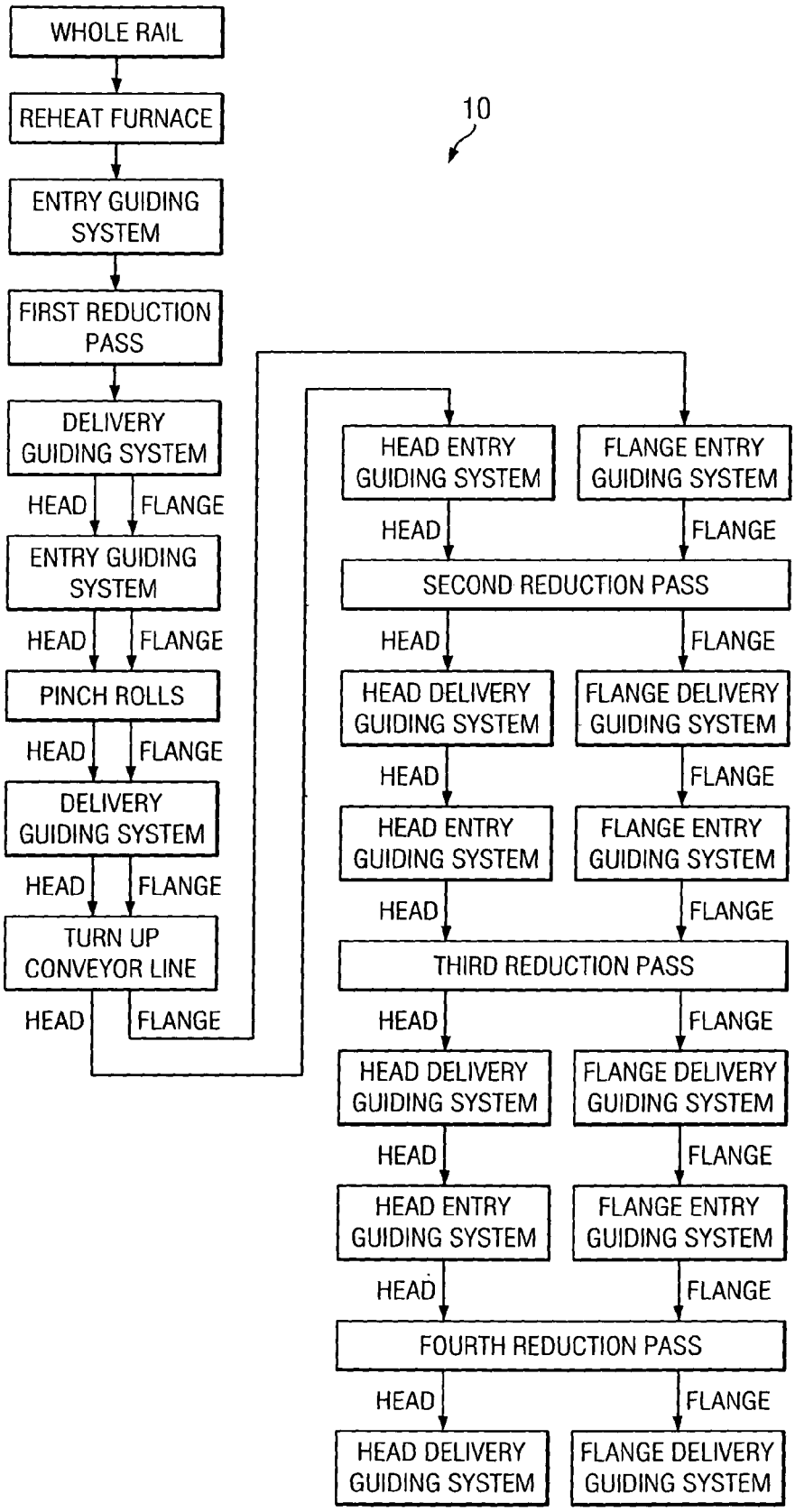
FIG. 1 is a block diagram depicting a rail recycling process according to one embodiment of the present disclosure.
Figure 2A:
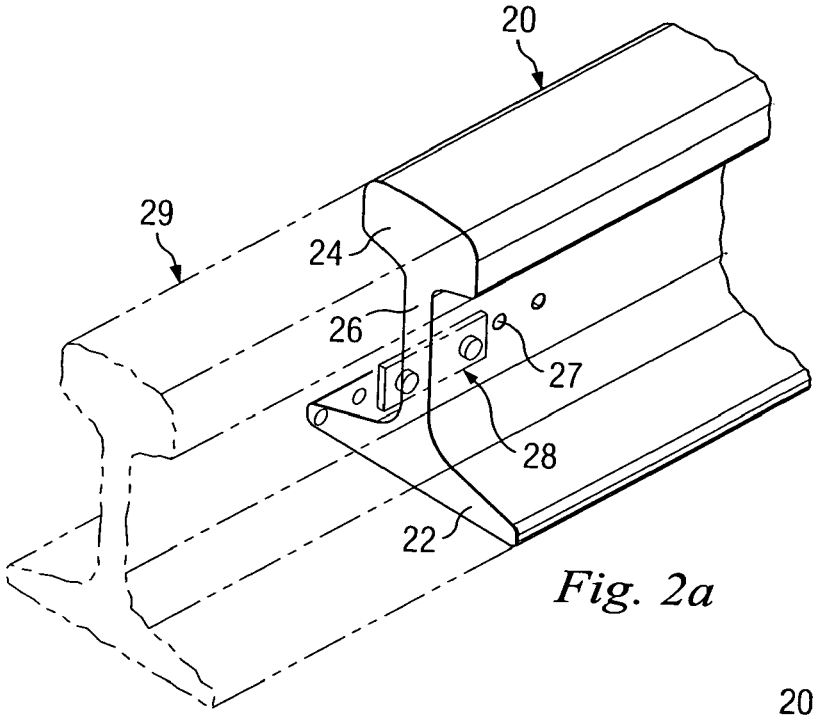
FIG. 2*a* is a schematic perspective view of a whole rail to be deformed according to the process depicted in FIG. 1.
Figure 2B:
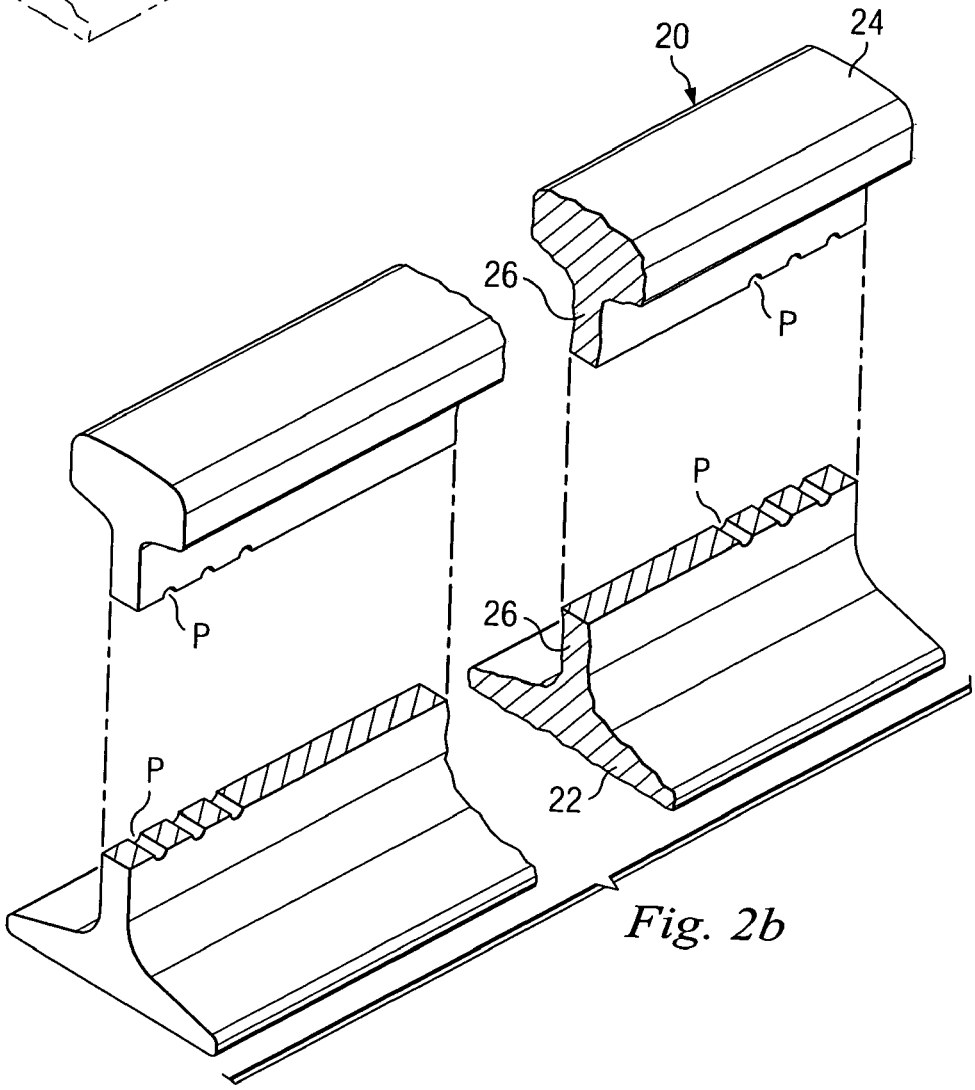
FIG. 2*b* is a schematic perspective view of the rail of FIG. 2*a* after having undergone a slitting process.

Referring to FIG. 1, a process for recycling whole rail according to one embodiment of the present disclosure is generally referred to by reference numeral 10. It is understood that whole rail is a term of art used to describe raw material for rolling mill operations. A substantial amount of the process 10 may be carried out in a single mill pass line as will be described. FIGS. 2*a*–3 depict a worn railroad rail 20 to be recycled in the rail recycling process 10. However, use of the railroad rail 20 is for sake of example only and various other types of whole rail are contemplated for use with the rail recycling process 10.

The railroad rail 20 is of conventional design, and as such, includes a lower portion 22, an upper portion 24, and a web portion 26 linking the lower and upper portions. In one embodiment, and with specific reference to FIG. 2*a*, the rail 20 includes at least one hole 27 formed laterally through the web portion 26. Such holes are common in railroad rail as they facilitate mounting of the rail 20 during formation of a track for a railroad, and thus there are typically a plurality of such holes adjacent each end of a rail, as shown in FIG. 2*a*. As an example, the hole 27 and the like corresponding holes may receive a clamping element 28 to connect the rail 20 with an adjacent rail 29.

Referring back to FIG. 1, the rail 20 is first inserted into a furnace in which the rail is heated to facilitate deforming of the rail. In one embodiment, the rail 20 is heated to a plastic state. The rail 20 is then discharged from the furnace and enters a first reduction pass entry guiding system, which aligns and centers the rail for entry into a first reduction pass.

It is understood that the term "entry guiding system" (hereinafter "EGS") is a term of art in the industry, which generally defines an entry system having conventional guiding components such as entry guides and guide boxes for delivering rail to a reduction pass used in rolling operations. Furthermore, it is understood that the term "reduction pass" is also a term of art in the industry, which generally defines conventional deformation components such as a pair of cast iron cylinders, or rolls, which rotate in opposite directions to deform rail. Since the components of the entry guiding system and the reduction pass are conventional, they are not shown, nor will they be described, in detail.

Referring to FIG. 4, deformation and slitting of the rail 20 takes place in the first reduction pass such that the rail is separated into two pieces—a head 30 (comprising the upper portion 24 and partial web portion 26 of the rail in FIG. 3) and a flange 32 (comprising the lower portion 22 and partial web portion 26 of the rail in FIG. 3). In one embodiment, and with additional reference to FIG. 2*b*, slitting of the rail 20 takes place across the hole 27 and any like corresponding holes and is accomplished via a single set of slitting knives (not shown) associated with the first reduction pass. Slitting across the hole 27 is advantageous as it creates a partial hole P in each of the head 30 and the flange 32, which reduces the probability of forming structurally deficient seams in the head and the flange as will be described. The term "partial hole" is a general term, which describes the result of splitting the hole 27, and is therefore not limited to any specific size or orientation.

Referring again to FIG. 1, in one embodiment, the rail 20 exits the first reduction pass still intact and enters a first reduction pass delivery guiding system where the head 30 is separated from the flange 32. It is understood that the term "delivery guiding system" (hereinafter "DGS") is a term of art in the industry, which generally defines a delivery system having conventional delivery components such as delivery guides and guide boxes to extract rail from a reduction pass and deliver it to the next element of the mill pass line. Since the components of the delivery guiding system are conventional, they are not shown, nor will they be described, in detail.

The head 30 and the flange 32 then enter a pinch roll EGS while simultaneously remaining in the first reduction pass DGS. The pinch roll EGS delivers the head 30 and the flange 32 to a pair of pinch rolls, which generally apply pressure to the head 30 and the flange 32 such that the head and the flange are pulled in a direction away from the first reduction pass, thereby removing the head and the flange from the first reduction pass DGS. The head 30 and the flange 32 then exit the pinch rolls and enter a pinch roll DGS for aligning the head and flange onto a conveyor line (not shown).

The conveyor line delivers the head 30 and the flange 32 to separate second reduction pass EGSs. While on the conveyor line, the head 30 and the flange 32 may be rotated substantially 90° for insertion into the head second reduction pass EGS and flange second reduction pass EGS, respectively. In one embodiment, the rotation of the head 30 and the flange 32 is accomplished via a plurality of conveyor rollers (not shown), which rotate the head and the flange in stages, such as can be accomplished via usage of a "turn up" conveyor line. It is understood that in no-twist mills, no rotation is necessary. Upon entry into their respective second reduction pass EGSs, the head 30 and the flange 32 are guided, in turn, into a second reduction pass.

The flange 32 then enters the second reduction pass in which further deformation of the flange takes place. In particular and referring to FIG. 5*a*, the web portion 26 of the flange 32 is edged back into the lower portion 22 such that the flange 32 begins to take a generally uniform shape. The flange 32 then exits the second reduction pass and enters a flange second reduction pass DGS where it is held from further advancement via a stop (not shown).

Upon exiting of the flange 32 from the second reduction pass, the head 30 enters the second reduction pass. In particular and referring to FIG. 5*b*, the web portion 26 of the head 30 is edged back into the upper portion 24 such that the head 30 begins to take a generally uniform shape. The head 30 then exits the second reduction pass and enters a head second reduction pass DGS.

At this point, the flange 32 remains in the flange second reduction pass DGS via the stop, and the head 30 proceeds to enter a head third reduction pass EGS, which aligns the head for entry into a third reduction pass. Referring to FIG. 6*b*, the third reduction pass deforms the head 30 to further the process of deforming the head into a generally uniform shape. The head 30 then exits the third reduction pass and enters a head third reduction pass DGS (FIG. 1).

Upon exiting of the head 30 from the third reduction pass, the flange 32 enters a flange third reduction pass EGS, which aligns the flange for entry into the third reduction pass. Referring to FIG. 6*a*, the third reduction pass deforms the flange 32 to further the process of deforming the flange into a generally uniform shape. The flange 32 then exits the third reduction pass and enters a flange third reduction pass DGS (FIG. 1).

Simultaneously with the deformation of the flange 32 in the third reduction pass, the head 30 enters a fourth reduction pass EGS, which aligns the head for entry into a fourth reduction pass. Referring to FIG. 7*b*, upon entry into the fourth reduction pass, the head 30 is again deformed to further the process of deforming the head into a generally uniform shape. The head then exits the fourth reduction pass and enters a fourth reduction pass DGS (FIG. 1).

Upon exiting of the head 30 from the fourth reduction pass, the flange 32 enters a flange fourth reduction pass EGS, which aligns the flange for entry into the fourth reduction pass. Referring to FIG. 7*a*, the fourth reduction pass deforms the flange 32 to further the process of deforming the flange into a generally uniform shape. The flange 32 then exits the fourth reduction pass and enters a flange fourth reduction pass DGS (FIG. 1).

As illustrated in FIGS. 7*a* and 7*b*, upon exiting the fourth reduction pass, the head 30 and the flange 32 have substantially the same generally uniform shape. Additionally, the head 30 and the flange 32 have a reduced cross-sectional area relative to the cross-sectional area of the head and the flange prior to undergoing the above-described deformation process. The head 30 and the flange 32 may then be rolled into a variety of desired finished products by passing through additional reduction passes and associated EGSs and DGSs.

The benefits of the above-described process are multifold. First, by slitting the rail 20 along the web 26, two pieces of the rail—the head 30 and the flange 32—require deforming rather than three pieces of rail as results from conventional multi-slitting processes that require separating the lower portion, the upper portion, and the web portion. By only having to deform two pieces of the rail 20, the above-described process 10 enjoys the advantage of requiring only one mill pass line for recycling of the rail. Thus, the rail recycling process 10 reduces the amount of equipment and number of employees needed to recycle rail.

Furthermore, slitting of the rail along the web 26 is advantageous in recycling the rail 20 into a structurally-sound, substantially seam-free finished product. By slitting the rail 20 across the hole 27 formed through the web portion 26, the formation of structurally deficient seams is effectively avoided. Moreover, the portion of the rail 20 containing the hole 27 no longer needs to be scrapped. Thus, the above-described process increases the amount of rail that can be recycled, which reduces the amount of waste otherwise associated with the recycling of rail.

Although only a few exemplary embodiments of this disclosure have been described in detail above, those skilled in the art will readily appreciate that many other modifications are possible without materially departing from the novel teachings and advantages of the disclosure. For instance, the sequence in which the head 30 and the flange 32 pass through the reduction passes may vary. Furthermore, the number of reduction passes is variable depending on the desired amount of deformation and the desired finished product.

Moreover, the specific arrangement and structure of the EGSs, reduction passes, and DGSs is not critical to the above-described process. For example, although the reduction passes were described as a pair of rolls, the reduction passes may alternatively employ presses for deforming of the rail 20. Thus, the EGSs, reduction passes, and DGSs may be arranged in any manner and may include any structure that provides for deforming of the rail 20 in a single mill pass line.

Furthermore, use of the pinch rolls are optional and it is contemplated that the rail 20 may be recycled according to the present disclosure without such pinch rolls. Still further, transportation of the rail 20 through the mill pass line depicted in FIG. 1 is not limited to a specific arrangement. Moreover, the above-described process can be used in a no-twist mill without departing from the spirit of the disclosure. Accordingly, all such modifications are intended to be included within the scope of this disclosure as defined in the following claims.

What is claimed is:

1. A method for recycling a rail, comprising:

providing a rail;

heating the rail;

slitting the rail to separate the rail into a first piece and a second piece wherein the first piece is a flange and the second piece is a head; and deforming the flange and the head;

wherein slitting the rail and deforming the flange and the head, comprises:

passing the rail through a first reduction pass;

passing the rail from the first reduction pass to a first delivery guiding system;

separating the rail into the flange and the head in the first delivery guiding system;

passing the flange and the head from the first delivery guiding system to a first entry guiding system;

passing the flange and the head from the first entry guiding system to a pair of pinch rolls;

passing the flange and the head from the pinch rolls to a second delivery guiding system;

passing the flange and the head from the second delivery guiding system to a conveyor line;

passing the flange into a first flange entry guiding system and passing the head into a first head entry guiding system;

passing the flange from the first flange entry guiding system into a second reduction pass;

passing the flange from the second reduction pass to a first flange delivery guiding system;

passing the head from the first head entry guiding system to the second reduction pass;

passing the head from the second reduction pass to a first head delivery guiding system;

passing the head from the first head delivery guiding system to a second head entry guiding system;

passing the head from the second head entry guiding system to a third reduction pass;

passing the flange from the first flange delivery guiding system to a second flange entry guiding system;

passing the head from the third reduction pass to a second head delivery guiding system;

passing the flange from the second flange entry guiding system to the third reduction pass;

passing the flange from the third reduction pass to a second flange delivery guiding system;

passing the head from the second head delivery guiding system to a third head entry guiding system;

passing the head from the third head entry guiding system to a fourth reduction pass;

passing the flange from the second flange delivery guiding system to a third flange entry guiding system;

passing the head from the fourth reduction pass to a third head delivery guiding system;

passing the flange from the third flange entry guiding system to the fourth reduction pass; and passing the flange from the fourth reduction pass to a third flange delivery guiding system.

2. A method for reducing structural defects in a recycled rail, comprising:

providing a rail having a hole formed therein;

slitting the rail across the hole to separate the rail into a first piece and a second piece, whereby slitting the rail across the hole defines a partial hole in each of the first and second pieces; and deforming the first and second pieces of the rail in at least one reduction pass, whereby deformation of the first and second pieces elongates the partial holes of the first and second pieces.

3. The method of claim 2 wherein slitting the rail across the hole reduces scrap associated with deforming the first and second pieces of the rail.

* * * * *